United States Patent [19]

Resch

[11] Patent Number: 4,767,064

[45] Date of Patent: Aug. 30, 1988

[54] METHOD AND APPARATUS FOR THE GRINDING OF EXPLOSIVES

[75] Inventor: Heribert Resch, Kaufering, Fed. Rep. of Germany

[73] Assignee: Messerschmitt-Bölkow-Blohm GmbH, Fed. Rep. of Germany

[21] Appl. No.: 934,179

[22] Filed: Nov. 20, 1986

[30] Foreign Application Priority Data

Jan. 1, 1986 [DE] Fed. Rep. of Germany ..... 3601593

[51] Int. Cl.[4] ..... B02C 23/18

[52] U.S. Cl. ..... 241/21; 241/24; 241/29; 241/101 B

[58] Field of Search ..... 241/101 B, 62, 21, 81, 241/24, 29; 366/142, 192, 194, 195, 153, 131, 184, 279

[56] References Cited

U.S. PATENT DOCUMENTS

| | | | |
|---|---|---|---|
| 4,259,022 | 3/1981 | Folland | 366/153 X |
| 4,416,424 | 11/1983 | Burke | 241/101 B |
| 4,557,605 | 12/1985 | Kenney et al. | 366/279 X |

*Primary Examiner*—Mark Rosenbaum
*Attorney, Agent, or Firm*—McGlew and Tuttle

[57] ABSTRACT

In a method for the wet grinding of explosive, a homogeneous suspension with a given ratio of water to explosive of e.g. 4:1 is produced in a vessel with an agitator. The level in the vessel (10) is adjusted as the suspension is being supplied to the mill in such a way that it does fall below the level of the blades of the agitator.

7 Claims, 2 Drawing Sheets

METHOD AND APPARATUS FOR THE GRINDING OF EXPLOSIVES

FIELD AND BACKGROUND OF THE INVENTION

The invention relates in general to explosive handling devices and in particular to a new and useful method and apparatus for the grinding of explosives, in which an explosive/water mixture is supplied to a mill, and the water is separated again from the ground-up explosive.

Explosives, such as octogen or hexogen, are available on the market in granulated form. For various production cases, however, they must be ground again. Thereby a defined, fine grain size distribution is achieved, which in the subsequent processing (e.g. pressing or pouring of an explosive charge from the explosive) has a decisive influence on the explosive density and hence the explosive power.

To illustrate problems which the present inventors have faced, an internal secret method of wet grinding of explosives, as practiced until now by the Applicant, will be explained more specifically with reference to FIG. 1 of the drawing, which schematically illustrates the grinding apparatus used by the applicant until now.

According to this internal method, inside a safety box (not shown), there is arranged, over a colloid or grinding mill 1 with a motor 2 and a hopper 3 on a stand 4, a charging hopper 5 which is closable with an inner cone 6 and into whose upper region a water conduit 7 leads. The explosive charge 8 is placed by hand in the charging hopper 5 closed with an inner cone 6, the mill 1 is flushed with water via a conduit (not shown). The inner cone 6 is raised, and then the explosive charge 8 is flushed with water from line 7 into the mill 1, whereupon the explosive/water mixture is ground in mill 1. The ground explosive is then conveyed to a suction filter 9, to separate the water from the explosive again. The grinding process is set in motion and supervised from outside the safety box.

In this plant-internal method the ratio of water to explosive in the mixture supplied to the mill varies considerably during the grinding of the explosives due to the flushing-in process. In particular, explosive may accumulate at the inlet of the mill 1.

This leads to problems of safety as well as of grinding. In the wet grinding of explosive, in fact, the explosive/-water mixture supplied to the mill 1 must, for safety reasons, not fall below a certain ratio of water to explosive. For octogen or hexogen the lower limit of this ratio is about 3:1. On the other hand, too high a ratio of water to explosive in the mixture, that is for instance a ratio of 6:1, leads to a reduced grinding output. Through the considerable variation of the ratio of water to explosive in the mixture supplied to the mill, the 3:1 ratio may therefore either easily drop off below the safe ratio, or through too high a ratio the grinding output may be reduced. Moreover, the variation of the ratio of water to explosive in the mixture supplied to the mill, that is, an irregular mill throughput, diminishes the quality of the ground product through respective fluctuations of the grain size distribution.

Furthermore, the explosive charge 8 may contain foreign matter, in particular metal particles, which damage the mill or even trigger an incident.

SUMMARY OF THE INVENTION

As distinguished from this internal state of the art, the invention provides an improved grinding of explosives with respect to safety, grain size distribution and grinding output.

Accordingly, it is an object of the invention to provide a method of grinding explosive using a vessel which has an agitator with an agitator element which is operable adjacent the bottom of the vessel and including a grinding mill arranged adjacent the vessel which comprises reducing the explosive into smaller particles and directing water in the particles into the vessel to produce a water and explosive suspension mixture having a predetermined explosive to water mixture ratio, directing a portion of the suspension mixture into the grinding mill in an amount so as to insure that the level of the mixture does not fall below the level of the agitator in the vessel. An apparatus for this purpose includes a vessel which has a withdrawal connection for the suspension mixture which is located at a predetermined level above the operating level of a rotatable blade actuator so that any of the suspension which is drawn off will be such that the level cannot fall below this withdrawal level.

A further object of the invention is providing a device for handling explosives to carry out a grinding up of the explosive which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 2:
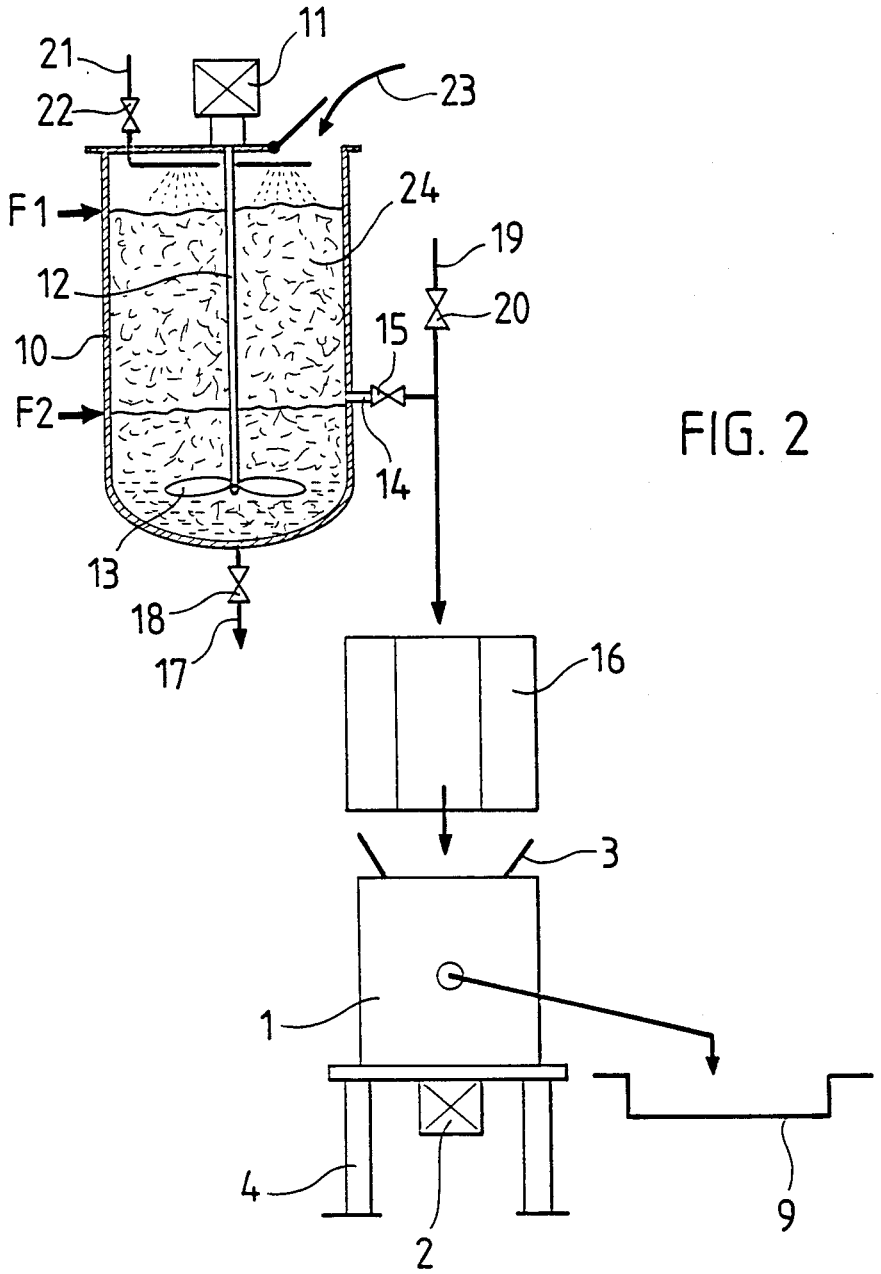
FIG. 2 is a similar view of an improved mixture suspension forming device which is oriented to feed a selective portion of the explosive suspension mixture to a grinding mill and which is constructed in accordance with the invention.

Referring to the drawings in particular as indicated in FIG. 2, the invention embodied therein comprises a vessel generally designated 10 which receives an explosive substance after it is broken into small particles and combined with water fed through a water conduit 21 and in the form of a spray controlled by a valve 22 into the vessel 10 so as to produce a water and explosive suspension mixture 24 which has a predetermined ratio of water to explosive. In accordance with the invention, the substantial portion of suspension 24 is fed into a foreign body separator and thence into a grinding mill 1 from the vessel 10 by tapping the mixture through an outflow line or draw-off 14, which in accordance with the invention is situated above an agitator device in the form of blades 13 which operates in the lower portion of the vessel 10. The draw-off line 14 is located so as to be a predetermined height above the operating level of the blades 13 so as to insure that the level of the mixture does not fall below the operating level of the agitator or blades 13 and sufficient water will remain in the suspension to avoid any hazardous situation.

The invention is explained more specifically below with reference to FIG. 2 of the drawing, which schematically illustrates a form of realization of the apparatus of the invention.

Figure 1:
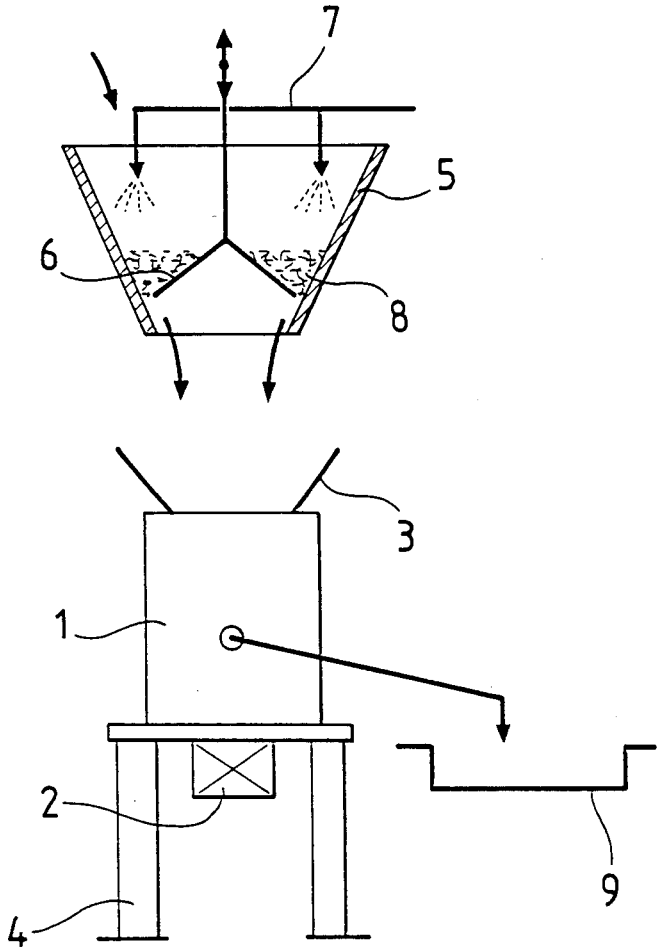
FIG. 1 is a partial elevational and partial sectional view of a combined mixer and grinding mill of the prior art.

The colloid mill 1 with suction filter 9 is designed in the same manner as in FIG. 1.

According to FIG. 2, there is arranged above mill 1 a vessel 10 provided with an agitator 11 which has a shaft 12 which drives a stirring elements 13 in the form of blades.

Connected to vessel 10 is an outflow line 14 which connects into the vessel 10 above the blades 13. The outflow line 14 is closable by a shut-off member 15 in the form of a valve.

By its other end the outflow line 14 leads into a foreign body separator 16 disposed above the mill 1. Since in particular metal particles getting into the mill are highly problematical for safety reasons, the separator 16 may be a magnetic separator.

At the bottom of vessel 10 an outflow line 17 is connected, which is closable by a valve 18.

Downstream of valve 15, in the outflow line 14 to the foreign body separator 16, a water conduit 19 is connected, which is closable by a valve 20. An additional water conduit 21 with a valve 22 leads into the vessel 10 at the top.

The apparatus shown in FIG. 2 is arranged in a safety box.

With this apparatus the method of the invention is carried out as follows:

First the empty vessel 10 is filled, water being added via line 21 until it reaches at least the level of the blades 13 of the agitator 11. Then the amount of explosive necessary for the given ratio is placed in the vessel 10 from above in the direction of arrow 23 while stirring. When grinding octogen or hexogen, this ratio is 4 parts by weight of water to one part by weight of explosive.

The level in vessel 10 is adjusted so that it does not go beyond the active zone of agitator 11, i.e. for example not beyond an upper level F1.

Then the homogeneous suspension 24 in vessel 10 can be supplied to the foreign body separator 16 or respectively to the mill 1 via the outflow line 14 by opening valve 15, until the level in vessel 10 reaches the height of lower level F2, i.e. the mouth of the outflow line 14 in vessel 10. In this manner, according to the invention, when the suspension 24 is supplied to the mill 1, the level in vessel 10 is always adjusted so that it does not fall below the level of the blades 13 of agitator 11.

This measure is essential for the reason that the blades 13 must be arranged at a certain distance from the bottom of vessel 10. But if the level in vessel 10 sinks below the level of the blades 13, the blades are no longer active, so that the heavy explosive particles soon settle in the suspension 24. Therefore, if the outflow line 14 were arranged, not on the side above the blades 13, but at the bottom of vessel 10, deviation from the desired 4:1 ratio of water to explosive in the mixture supplied to mill 1 and possibly clogging of the outflow line would result.

By contrast, according to the invention, the desired ratio of explosive to water of 1:4 can be maintained in the sump below the mouth of the outflow line 14, and thus during the entire operation of the apparatus, due to the lateral connection of the outflow line 14 above the blades 13.

Moreover, by the arrangement of the mouth of the outflow line 14 in vessel 10 above the bottom of vessel 10, heavy foreign bodies, such as metal particles, can settle on the bottom of vessel 10 and are thereby made harmless.

The outflow line 17 at the bottom of vessel 10 serves to evacuate the vessel, e.g. when a different explosive is to be ground with the apparatus.

In vessel 10 a level measuring device (not shown) is provided. Further, the apparatus comprises a device not shown for actuating the shut-off member or valve 15 in the outflow line 14. Thus, for reasons of safety, the shut-off member 15 can be opened and hence, the explosive/water suspension 24 supplied to the mill 1 only when the level measuring device measures a level lying above the level of the blades, i.e. for example the level F2. The agitator 11 and motor 2 of mill 1 are turned on, only after the mill 1 has been flushed with water via the water conduit 19 beforehand.

By the invention, therefore, charging of the mill with an explosive/water mixture of uniform composition is achieved. Safety as well as the quality of the ground material are thereby increased.

Further, it is no problem to insert the foreign body separator 16 between the vessel 10 and the mill 1. And, as has been mentioned, foreign bodies that may be contained in the explosive deposit on the bottom of the vessel without becoming dangerous.

Further, the mill 1 can readily be charged with two such vessels 10 one behind the other, i.e. the operator needs to enter the safety box 50% less often in order, for example, to introduce the explosive into the vessels 10 by hand. Also the apparatus according to the invention can be automated to a large extent.

What is claimed is:

1. A method of grinding explosives using a vessel having an agitator with agitator elements operable adjacent the bottom of the vessel and including a grinding mill adjacent the vessel, comprising reducing the explosive into smaller particles and directing water and the particles into the vessel to produce a water and explosive suspension mixture which has a predetermined ratio of water to exlosive, and directing a portion of the suspension mixture into the grinding mill in an amount so as to insure that the level of the mixture does not fall below the level of the agitator, and grinding the suspension mixture in the grinding mill.

2. A method according to claim 1, wherein after grinding the suspension mixture, including separating out the water from the ground suspension mixture.

3. A method according to claim 1 wherein the vessel is filled by first adding water until it reaches at least the level of the agitator element thereafter the explosive is added to a selected quantity to give a selected water to explosive ratio.

4. A method according to claim 3 wherein the grinding is effected by a rotatable blade and wherein the suspension is filled at least to the level of the blade and thereafter water is added together with a quantitiy of explosive required for a given ratio into the vessel.

5. A method according to claim 4 wherein the level of the vessel is adjusted so that it does not go beyond the active zone of said blade.

6. A method according to claim 5 wherein the ratio of water to explosive is 4:1.

7. A method according to claim 4 wherein an explosive octogen and hexogen is ground and the given ratio of water to explosive is at least from 3:1.

* * * * *